US005470144A

United States Patent [19]

Wen

[11] Patent Number: 5,470,144

[45] Date of Patent: Nov. 28, 1995

[54] DRAWER WITH A RAIL STRUCTURE COMPATIBLE WITH A SINGLE RAIL OR MULTI-RAIL ASSEMBLY IN A CABINET

[76] Inventor: Cheng-Kan Wen, No. 35, Lane 304, Sec. 1, Chien Kao S. Rd., Taipei, Taiwan

[21] Appl. No.: 184,694

[22] Filed: Jan. 21, 1994

[51] Int. Cl.[6] ..... A47B 88/10

[52] U.S. Cl. ..... 312/334.13; 312/334.12; 312/334.19; 312/324.44; 312/330.1

[58] Field of Search ..... 312/334.13, 334.12, 312/334.18, 334.19, 334.21, 334.33, 334.41, 334.42, 334.44, 330.1

[56] References Cited

U.S. PATENT DOCUMENTS

| | | | |
|---|---|---|---|
| 1,910,208 | 5/1933 | Gronberg et al. | 312/334.13 X |
| 2,361,116 | 10/1944 | Mayer | 312/334.12 |
| 2,687,924 | 8/1954 | Gomersall | 312/334.13 X |
| 2,859,070 | 11/1958 | Gomersall | 312/334.13 X |
| 3,298,768 | 1/1967 | Vogt | 312/334.12 |
| 3,716,284 | 2/1973 | Vogt | 312/334.19 X |
| 4,121,876 | 10/1978 | Ratti | 312/334.13 X |
| 4,181,383 | 1/1980 | Naef | 312/334.13 X |
| 4,453,790 | 6/1984 | Cohen et al. | 312/330.1 X |
| 5,181,782 | 1/1993 | Wojcik | 312/334.44 X |
| 5,211,461 | 5/1993 | Teufel et al. | 312/334.44 X |

*Primary Examiner*—José V. Chen
*Assistant Examiner*—Rodney B. White
*Attorney, Agent, or Firm*—W. Wayne Lianh

[57] ABSTRACT

A drawer structure adapted to a single rail assembly or a multi-rail assembly in a cabinet; a drawer rail stop furnished beneath the drawer rail can be stopped with a stop lug on the single rail assembly or the multi-rail assembly. A roller on the rear end of a drawer rail may be mounted in place for the single rail assembly, or omitted for the multi-rail assembly; in other words, the drawer is compatible with a single rail assembly and a multi-rail assembly.

2 Claims, 10 Drawing Sheets

DRAWER WITH A RAIL STRUCTURE COMPATIBLE WITH A SINGLE RAIL OR MULTI-RAIL ASSEMBLY IN A CABINET

BACKGROUND OF THE INVENTION

The tool cabinet and the document cabinet are widely used in factory and office for storing tools and parts, and documents. A plurality of drawers are usually mounted in a cabinet by means of bearings and sliding rails so as to facilitate the drawers to be pulled out and pushed in smoothly. The conventional drawers may be classified into two kinds of which one is adapted to the single rail assembly, while the other is adapted to the multi-rail assembly. As shown in FIG. 1, The drawer "C" mounted on a single rail assembly "A" is used for carrying light weight; the single rail assembly "A" has a simple structure, and the drawer "C" mounted thereon has a limited space to pull out, i.e., the drawer unable to be pulled out completely. A drawer "D" mounted on a multi-rail assembly "B" is used to carry heavy things; the multi-rail assembly "B" is retractable rail structure, which can extend forward to support a drawer "D", which can be pulled out completely, i.e., to have a longer opening length of the drawer so as to carry more weight; in other words, a drawer structure as to be designed into two models so as to facilitate the drawer to be mounted on the two different rail structure.

In the conventional cabinet, the drawers therein are designed into different heights for user's convenience, i.e., a cabinet may be mounted with several drawers having different height so as to save space and to meet a given requirement. However, drawers having different specifications would cause a higher cost to the manufacturer, and cause more space to be occupied with the items classified; therefore, such drawer system is deemed not economical to a manufacturer. If drawers have the same structure, but must be made into two kinds for adapting to the single rail and multi-rail assemblies, it would cause the products to become more complex, and to cause the manufacturing cost thereof to go higher.

SUMMARY OF THE INVENTION

This invention relates to a drawer structure adapted to a single rail assembly and a multi-rail assembly, and particularly to drawers to be compatible with a single rail and multi-rail assemblies in a tool cabinet and a document cabinet, etc. The bottom or the side of the drawer is furnished with a drawer rail stop to be stopped with a stop lug on the single rail and multi-rail assemblies. The rear end of the drawer rail is mounted with a detachable roller, which is to be mounted in place upon the drawer being mounted on a single rail assembly, and which is omitted upon the drawer being mounted on a multi-rail assembly; in other words, a drawer can be compatible with two different rail assemblies so as to make the manufacturing steps simple and easy, and also to make the storage and management of the products simple and easy in order to lower the manufacturing and management costs and to meet the economical requirement.

DETAILED DESCRIPTION

Figure 2:
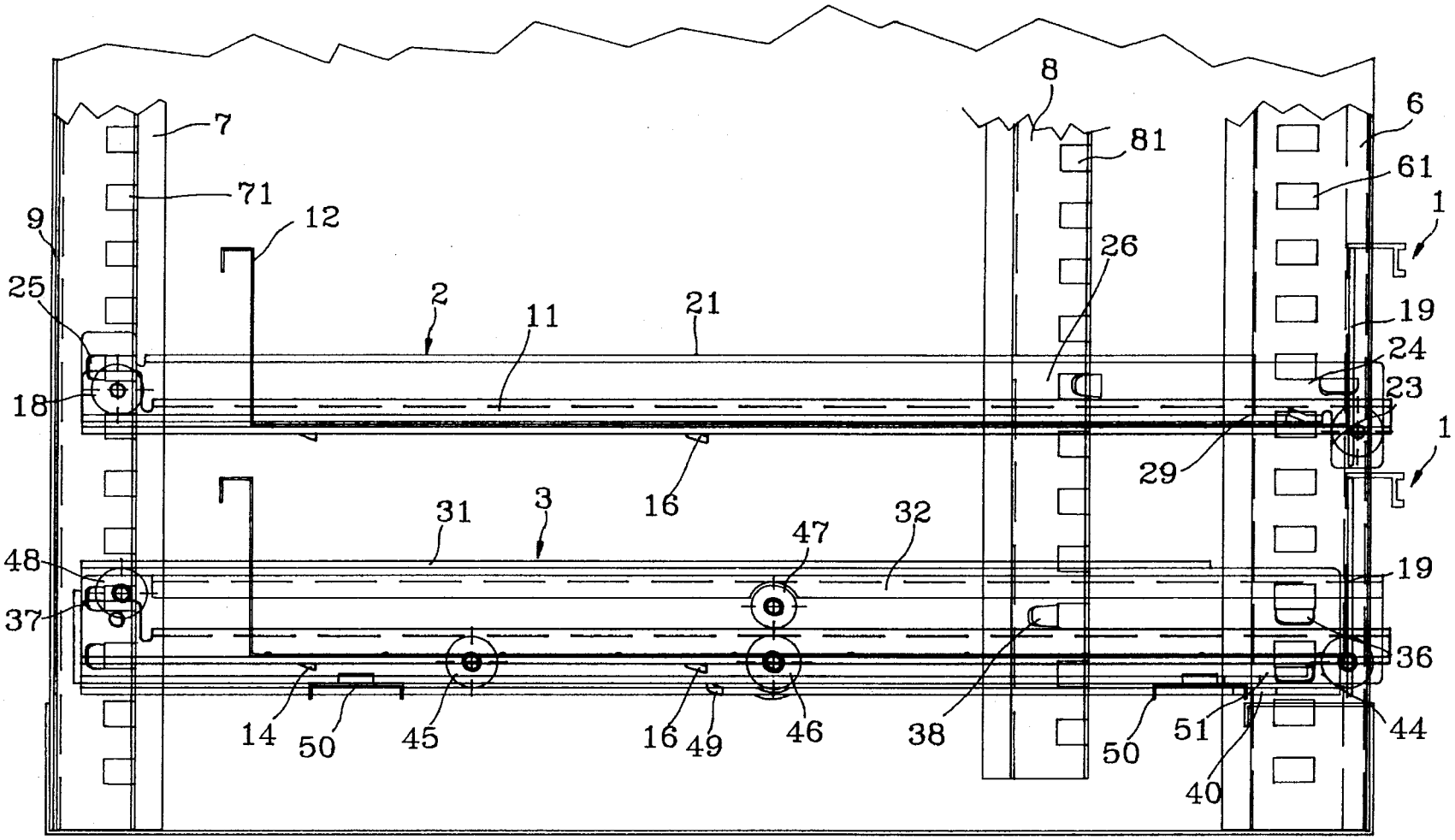
FIG. 2 is a side view of a cabinet with a single rail and multi-rail assembly according to the present invention.
Figure 3:
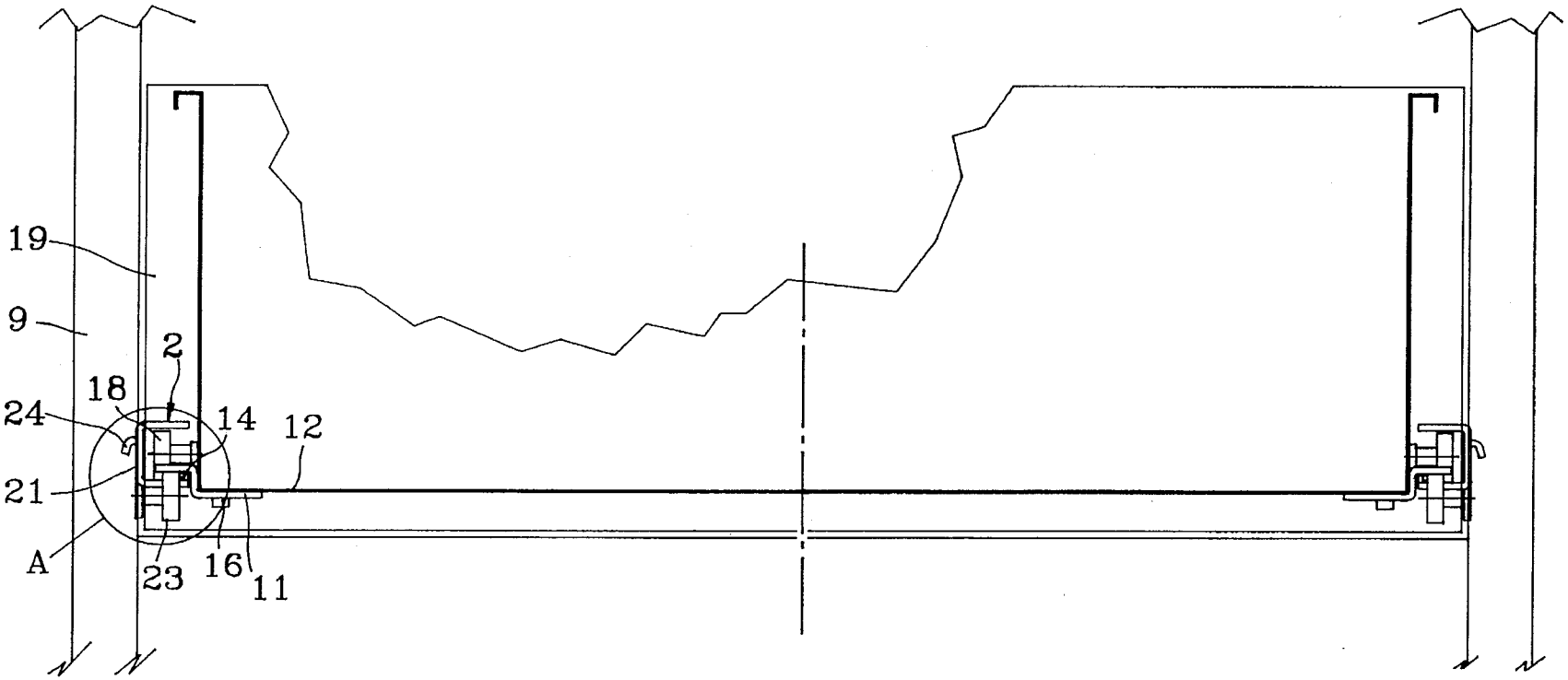
FIG. 3 is a front view of a single rail assembly according to the present invention
Figure 4:
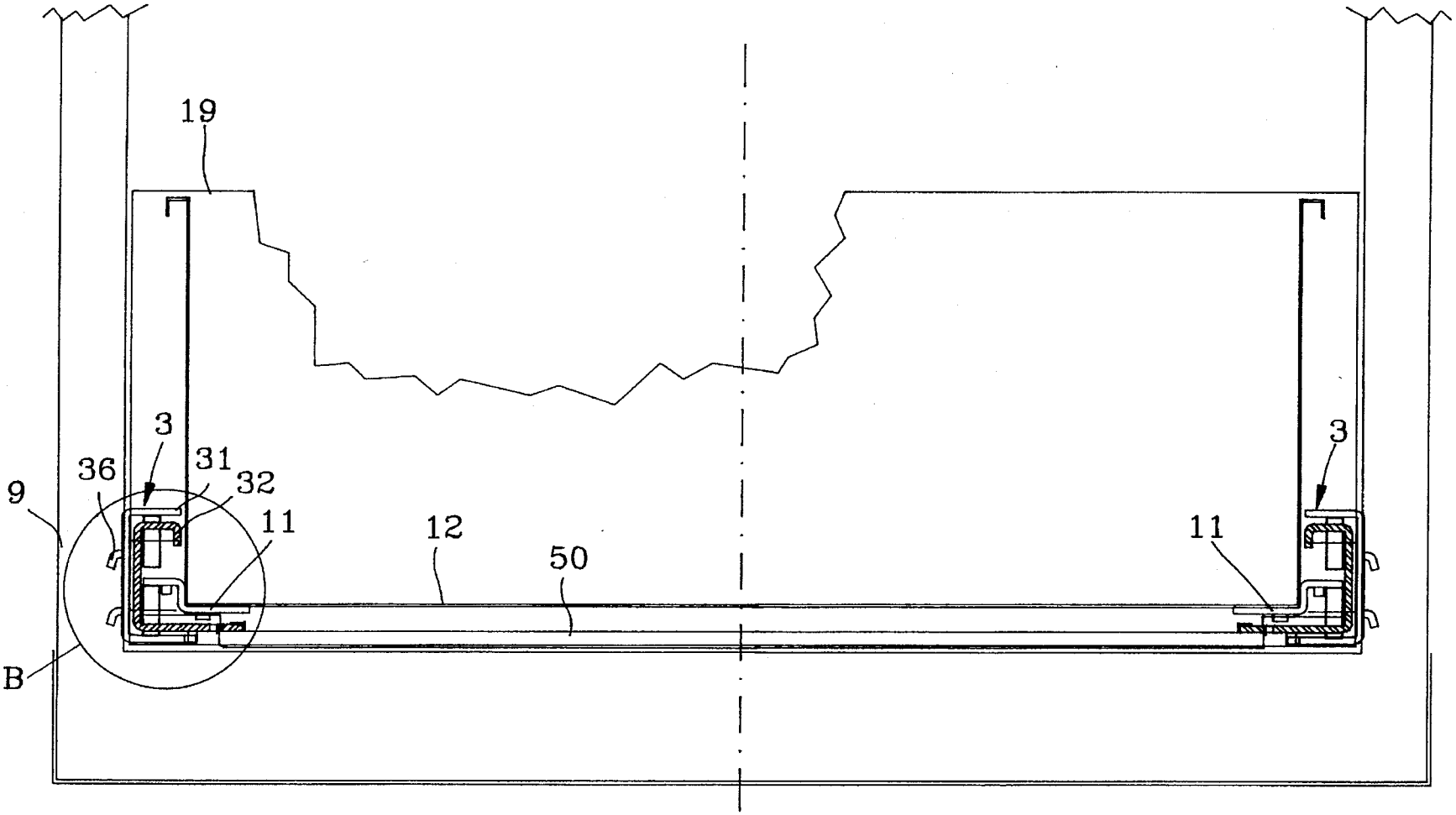
FIG. 4 is a rear view of a multi- rail assembly according to the present invention.

FIG. 2 is a side view of an embodiment of a drawer according to the present invention, which can be mounted on a single rail assembly or a multi-rail assembly; the present invention comprises a drawer 1, a single rail assembly 2, and a multi-rail assembly 3. The left and right bottom sides of the drawer 1 (as shown in FIGS. 3 and 4) are fastened with two drawer rails 11 respectively and symmetrically by means of welding, screw or riveting method. The description of the drawer rails 11 herein-after is limited to the left side drawer rail 11 only. Referring to FIGS. the drawer rail 11 is an elongated angle iron, of which the length is longer than that of the drawer body 12; the sectional view of the drawer rail 11 looks like a ⊓ stair shape. The rear end portion of the outside horizontal plate 13 of the drawer rail 11 has a drawer rail stop 14 for a single rail assembly. The bottom mid-portion of the inside horizontal plate 15 is furnished with a drawer rail stop 16; the rear end of the drawer rail 11 has a vertical lug 17 being mounted with a horizontal roller 18, which has to be mounted in place upon the drawer 1 is used with a single rail assembly 2, and has to be removed when the drawer 1 is used with a multi-rail assembly 3. The two drawer rails 11 are fixedly mounted beneath the left and right bottom sides respectively of the drawer body 12 behind the drawer panel 19. The top surface of the inside horizontal plate 15 of the drawer rail 11 is fixedly connected beneath the bottom of the drawer body 12.

Figure 5:
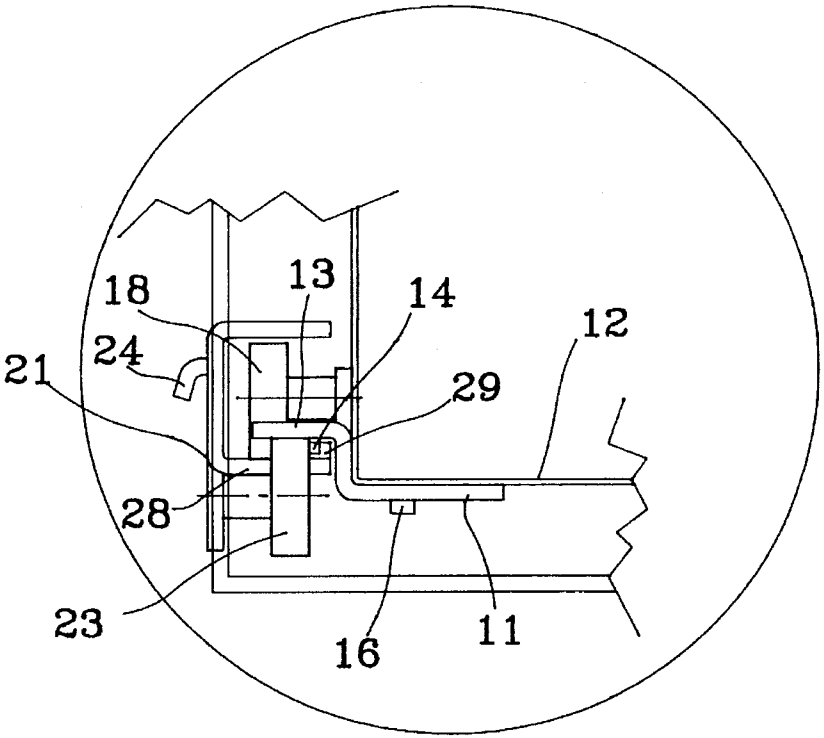
FIG. 5 is a fragmental enlarged view of the single rail assembly according to the present invention.
Figure 7:
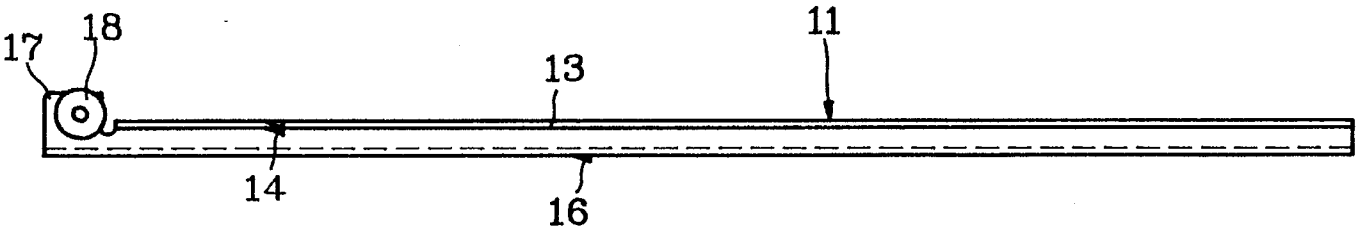
FIG. 7 is a side view of a drawer rail according to the present invention.
Figure 8:
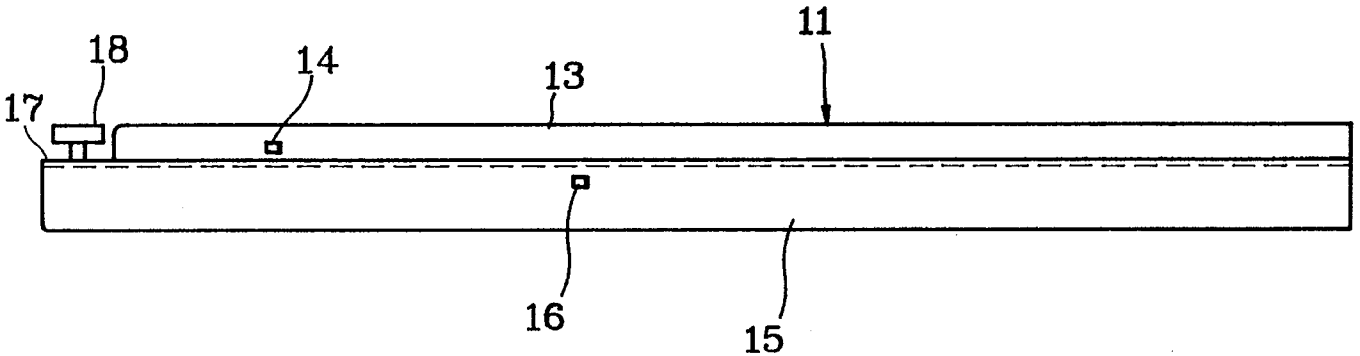
FIG. 8 is a bottom view of a drawer rail according to the present invention.
Figure 9:
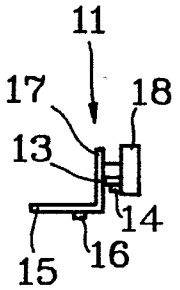
FIG. 9 is a sectional view of a drawer rail according to the present invention.
Figure 12:
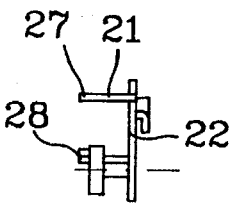
FIG. 12 is a sectional view of the fixed rail as shown in FIG. 11.
Figure 10:
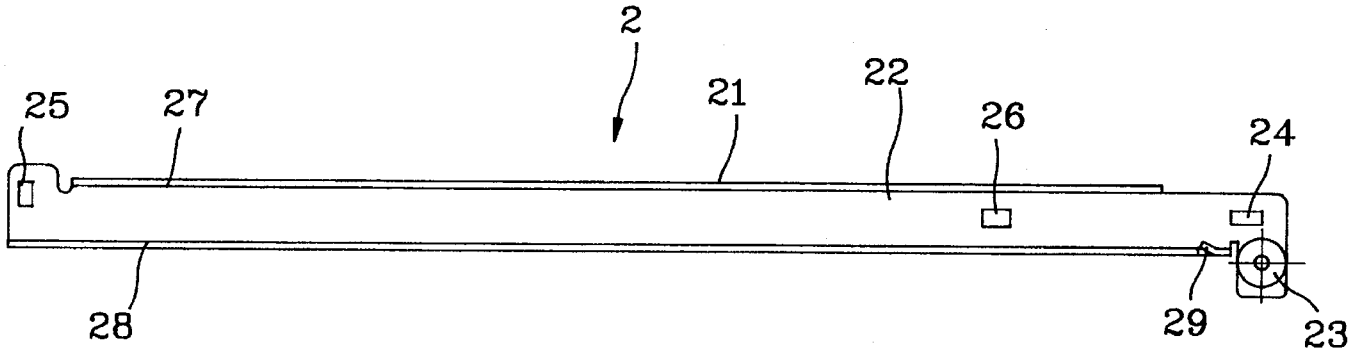
FIG. 10 is a side view of a fixed rail in a single rail assembly according to the present invention.
Figure 11:
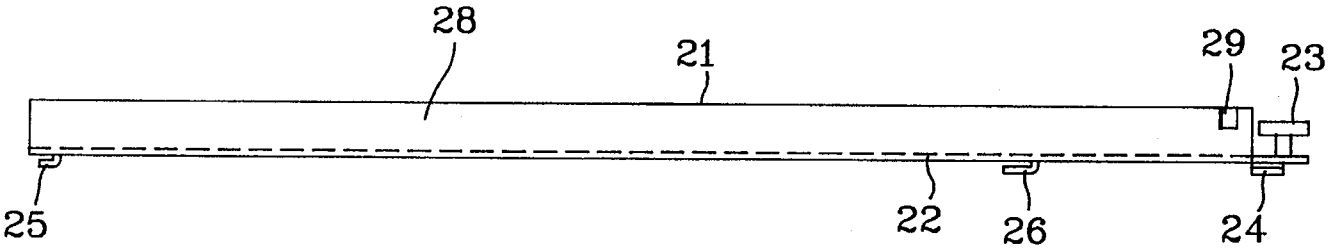
FIG. 11 is a bottom view of a fixed rail as shown in FIG. 10 .

The single rail assembly 2 includes a left and a right fixed rails 21 (as shown in FIGS. 3 and 5), which are symmetrical in shape; hereinafter, only the right fixed rail 21 is described further. Referring to FIGS. 10 to 12, the fixed rail 21 is an elongated metal plate, having a length about the same as that of the drawer rail 11; the sectional view of the fixed rail 21 is similar to a "⊐" shape. The inner side of the front end of the vertical plate 22 of the fixed rail 21 is mounted with a horizontal roller 23; both ends of the outer side of the fixed rail 21 are provided with a front hook 24 and a rear hook 25, between which a connection-and-fixed hook 26 is provided on the rail 21. The upper and lower sides of the vertical plate 22 are furnished with an upper horizontal plate 27 and a lower horizontal plate 28 respectively. The front end of the lower horizontal plate is provided with a stop lug 29 of the drawer rail.

Figure 6:
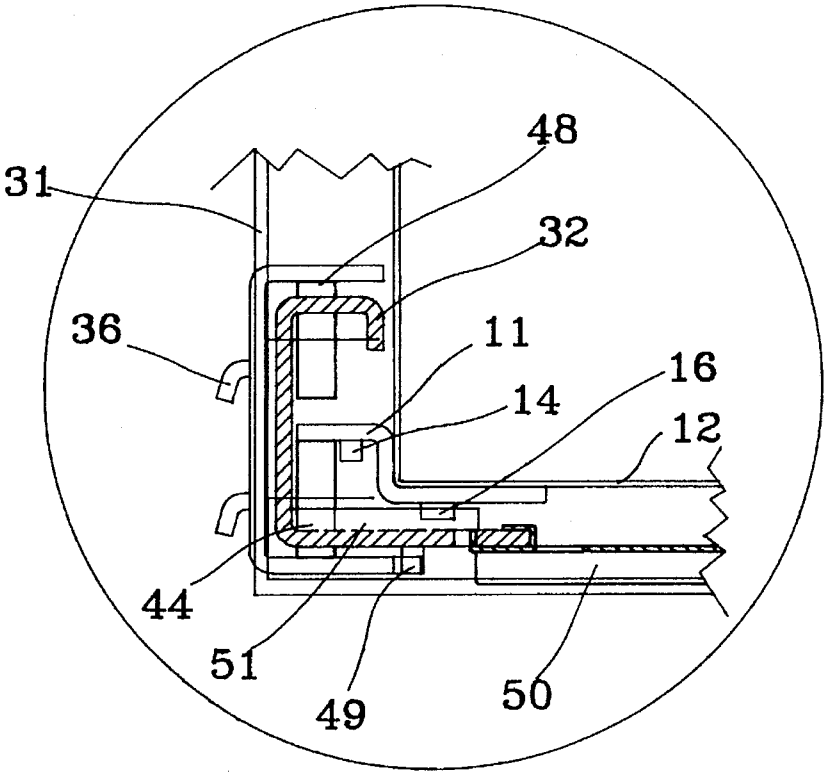
FIG. 6 is a fragmental enlarged view of the multi- rail assembly according to the present invention.
Figure 14:
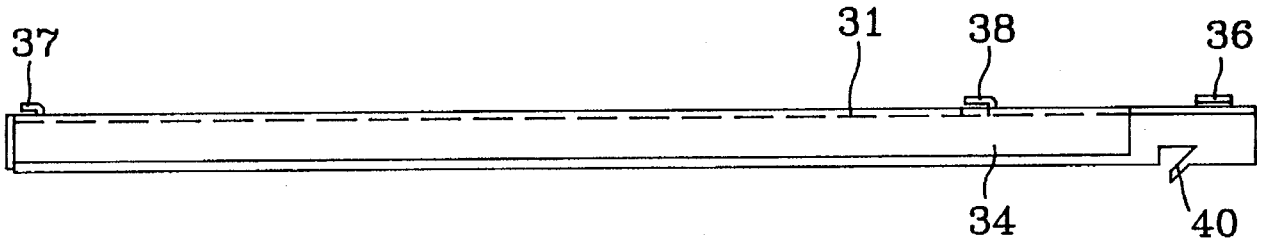
FIG. 14 is a top view of the fixed rail as shown in FIG. 13.
Figure 13:
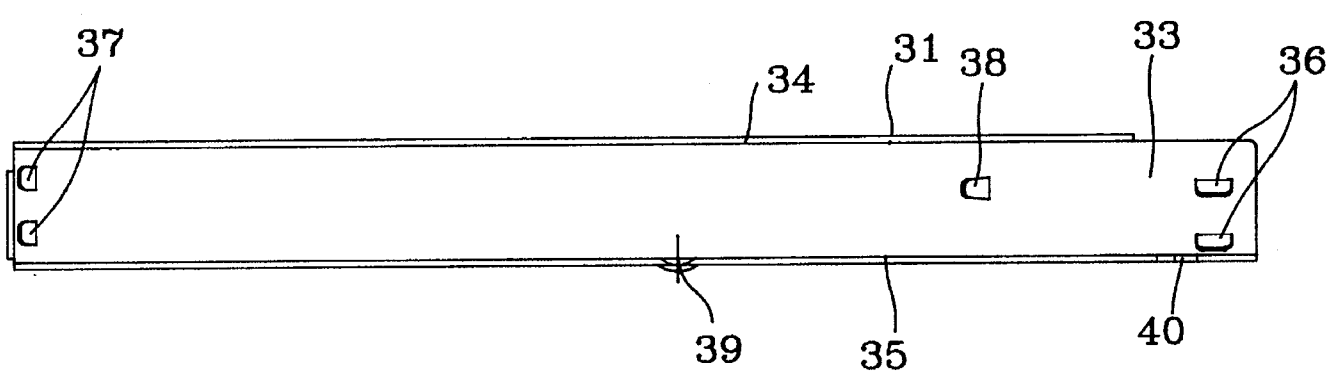
FIG. 13 is a side view of a fixed rail in a multi-rail assembly according to the present invention.
Figure 15:
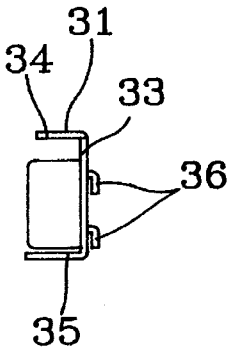
FIG. 15 is a sectional view of the fixed rail as shown in FIG. 13.
Figure 18:
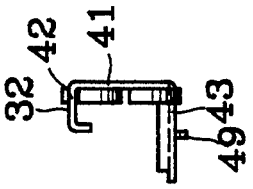
FIG. 18 is a sectional view of an extension rail as shown in FIG. 16.
Figure 17:
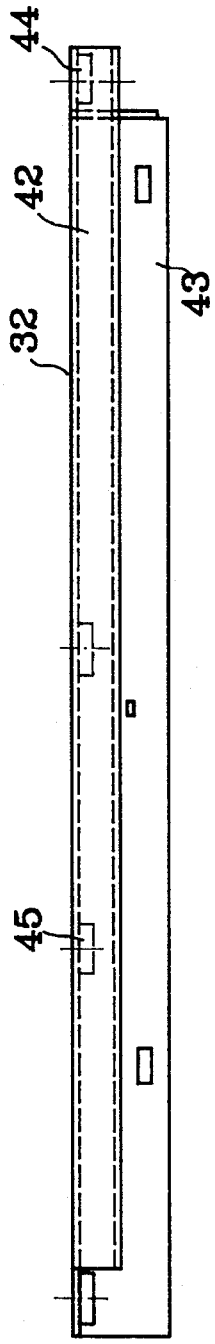
FIG. 17 is a top view of an extension rail as shown in FIG. 16.
Figure 16:
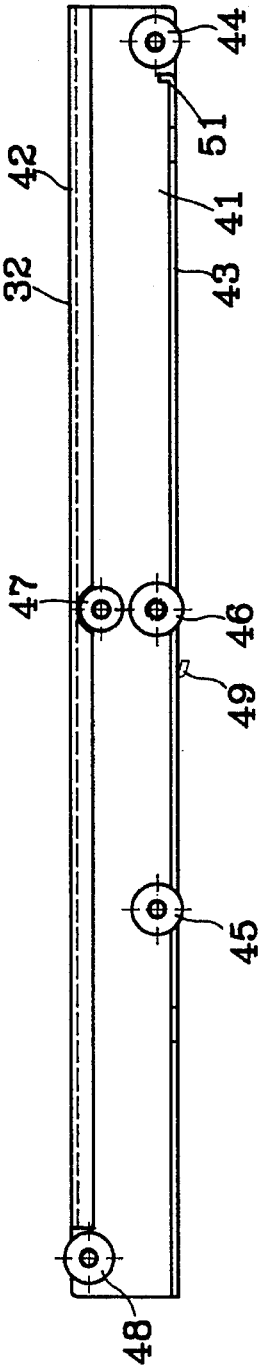
FIG. 16 is a side view of an extension rail in a multi-rail assembly according to the present invention.

The multi-rail assembly 3 includes a left and a right fixed rails 31 and two extension rails 32 (as shown in FIGS. 4 and 6); all the aforesaid fixed rails and extension rails are provided in symmetrical shape, and therefore all description hereinafter is limited to the right side rails. Referring to FIGS. 13 to 15, the fixed rail 31 is an elongated metal plate, being slightly longer than that of the drawer 1; the sectional view of the fixed rail 31 is in a "⊐" shape. Both the upper and lower sides of the vertical plate 33 of the fixed rail 31 are provided with an upper horizontal plate 34 and a lower horizontal plate 35 respectively. Both the front and rear ends of the outer side of the vertical plate 33 are furnished with two front hooks 36 and two rear hooks 37 respectively. A connection-and-fixed hook 38 is furnished between the front and rear hooks 36 and 37. The lower mid side of the fixed rail 31 is provided with a curved groove 39 for receiving a pressing roller 46. The front end of the lower horizontal plate 35 has a stop lug 40 of the extension rail. As shown in FIGS. 16 to 18, the extension rail 32 is an elongated metal plate, having a length equal to that of the fixed rail 31, and the sectional view thereof is in a "⊐" shape. The extension rail 32 is fitted movably in the inner side of the fixed rail 31. The extension rail 32 includes a vertical plate 41 to connect with an upper horizontal plate 42 and a lower horizontal plate 43. The front end and the mid-rear portion of the inner side of the vertical plate 41 are mounted with two horizontal rollers 44 and 45 respectively; The lower edges of the two horizontal rollers 44 and 45 are slightly protruded out of the bottom of the lower horizontal plate 43. The mid-portion of the inner side of the vertical plate 41 is mounted with a pressing roller 46, being protruded out of the bottom of the lower horizontal plate 43; a roller 47 is mounted over the pressing roller 46. The space between the roller 47 and the pressing roller 46 is to receive the outside horizontal plate 13 of the drawer rail 11. The rear end of the inner side of the vertical plate 41 is mounted with a horizontal roller 48, of which the upper edge protrudes out of the top side of the upper horizontal plate 42. The bottom of the lower horizontal plate 43 of the extension rail 32 is furnished with an extension rail stop 49. The front end of the lower horizontal plate 43 is furnished with a stop lug 51 of drawer rail. The lower horizontal plates 43 of the left and right extension rails 32 are connected together by means of two extension rail connecting plates 50 so as to let the two extension rails 32 move synchronously within the fixed rails 31. The extension rails 32 can move freely on the fixed rails 31. As soon as the extension rails 32 move toward the front about one half of their length, the extension rail stop 49 will be stopped by the stop lug 40 of the fixed rail so as to prevent the extension rails 32 from moving out continuously.

Figure 1:
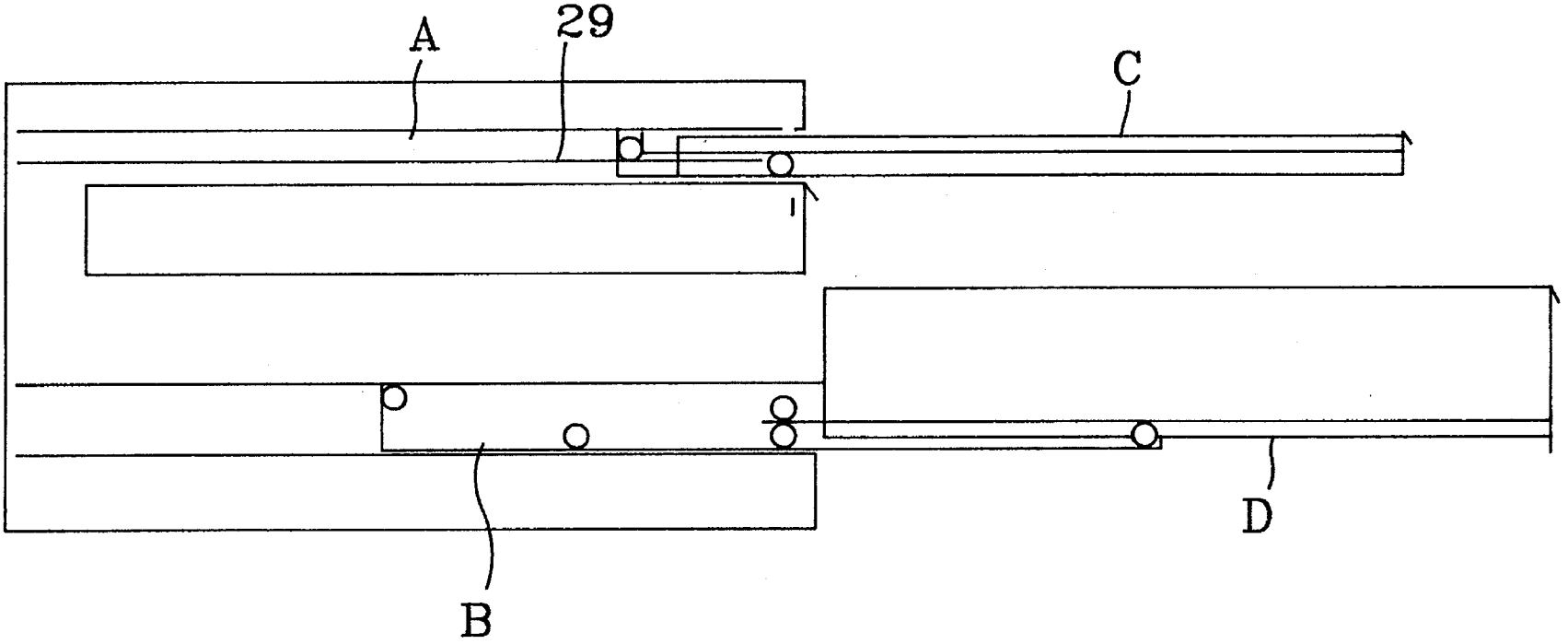
FIG. 1 is a side view of a conventional cabinet with a single rail and multi-rail assembly.
Figure 19:
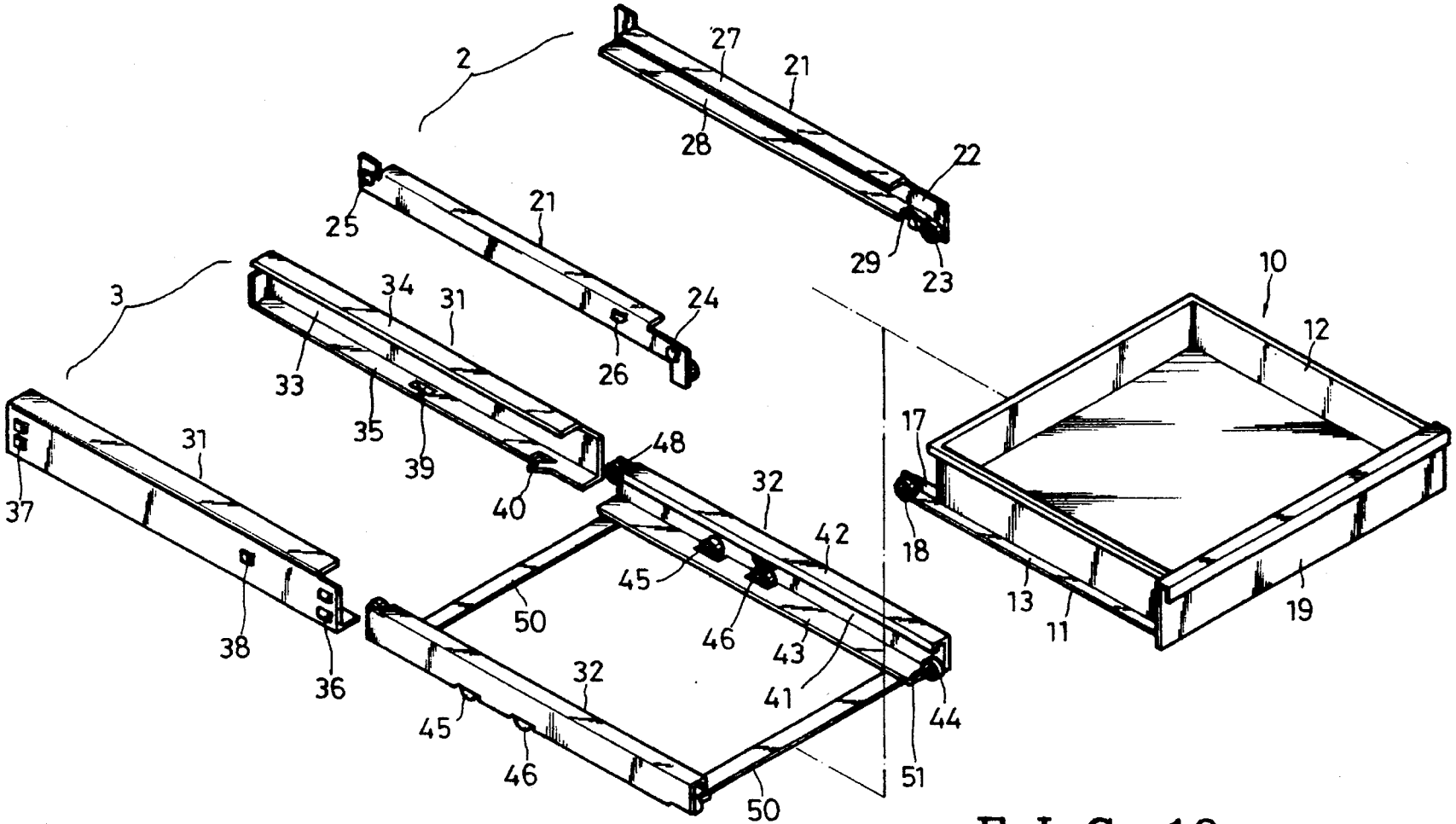
FIG. 19 is a disassembled view of the present invention.

Referring to FIGS. 2 and 19, the front hook 24 and the rear hook 25 of the two fixed rails 21 of the single rail assembly 2 are hooked into the hook holes 61 and 71 on the vertical front and rear supporting frames 6 and 7 respectively in the cabinet 9; the single rail assembly 2 is horizontally supported on the left and right sides in the cabinet 9. In the multi-rail assembly 3, the front hook 36 and the rear hook 37 of the two fixed rails 31 are hooked into the hook holes 61 and 71 on the front and rear supporting frames 6 and 7 respectively so as to support the multi-rear assembly 3 horizontally on the left and right sides in the cabinet 9. In order to have the single rail assembly 2 and the multi-rail assembly 3 mounted firmly in place, the left and right sides of the inner wall of cabinet 9 are installed with a fixed-rail positioning frame 8, which has a plurality of hook holes 81 to receive the connection-and-fixed hooks 26 and 28; when the drawer 1 and the rails 2 and 3 are being used, the weight of the other drawers and rails will, through the fixed-rail positioning frame 8, press and hold the front hooks 24 and 36 of the fixed rails 21 and 31 downwards so as to prevent the front hooks 24 and 36 from being separated from the hook holes 61 and 71. When the drawer 1 according to the prevent invention is mounted on a single rail assembly 2, the rear end of the drawer rail 11 must be mounted with a horizontal roller 18 (as shown in FIGS. 1, 3 and 5) so as to have the horizontal roller 18 move freely on the top surface of the lower horizontal plate 28 of the fixed rail 21; simultaneously, the horizontal roller 23 on the front end of the fixed rail 21 can roll along the bottom surface of the outside horizontal plate 13; by means of the two sets of rollers 18 and 23 on both sides, the drawer rail 11 of the drawer 1 can support the drawer 1 to move smoothly along the single rail assembly 2. Before the drawer 1 is pulled out completely, the drawer 1 will be stopped as a result of the drawer rail stop 14 on the drawer rail being stopped by a stop lug 29 on the fixed rail 21; then, the drawer 1 would not be pulled out of the cabinet to drop on floor.

When the drawer 1 according to the present invention is mounted on a multi-rail assembly 3, the roller 18 on the rear end of the drawer rail 11 is not to be mounted (as shown in FIGS. 2, 4 and 6). When the extension rail 32 is mounted in the fixed rail 31, the drawer 1 is then mounted on the extension rail 32 by means of the drawer rail 11. By means of the rollers 44, 45, 48 and the pressing roller 46, the extension rail 32 mounted in the fixed rail 31 can move smoothly. When the drawer 1 is pulled, the outside horizontal plate 13 of the drawer rail 11 will press on the pressing roller 46; simultaneously, the bottom surface of the outside horizontal plate 13 will be in close contact with the upper edge of the pressing roller 46 to generate a friction force, which would cause the pressing roller 46 to rotate. When the drawer 1 is pulled out the extension rail 32 will extend outwards because of the lower edge of the pressing roller 46 moving on the top of the lower horizontal plate 35 of the fixed rail 31, i.e., the drawer 1 and the extension rail 32 will slide forward simultaneously. As soon as the extension rail 32 moves outward about one half of its whole length, an extension rail stop 49 beneath the extension rail 32 will be stopped by a stop lug 40 of the extension rail, i.e., the extension rail 32 and the drawer 1 thereon can only extend out about one half of their length. Since the drawer 1 is mounted on the extension rail 32 by means of the drawer rail 11, the drawer 1 can also slide freely on the extension rail 32 by means of the drawer rail 11 and the rollers 44, 45, 47 and 48. When the drawer 1 moves along the extension rail 32 outwards about one half of its length, the drawer rail stop 16 of the drawer rail 11 will be stopped by means of the stop lug 51 of the drawer rail, and the drawer 1 can only extend out about one half of its length. When the drawer 1 is pulled out along the extension rail 32 about one half of its length, the extension rail 32 will also be driven to extend out along the fixed rail 31 about one half of its length, but the drawer 1 can be pulled out of the cabinet 9 completely, i.e., being opened 100%; in that case, the rear half of the extension rail 32 is still left in the fixed rail 31. A lever theory has been used in the aforesaid structure so as to increase the load capacity of the drawer and to have the drawer 1 supported firmly in place.

Since the present invention has such a special design, the drawers having the same specifications can be mounted on and adapted to the single rail assembly and the multi-rail assembly, i.e., it is unnecessary to provide two drawer structures for different rail assemblies; therefore, the product of the kind can be manufactured in a simple and easy manner to facilitate storage and handling thereof; then, the manufacturing and management cost thereof would also be reduced.

I claim:

1. A drawer structure compatible for use with a single rail or a multi-rail assembly, said drawer structure including a compatibility means to allow such compatibility, and said means comprising:

a pair of drawer rails affixed to a right and left side, respectively, of a drawer body, each of said drawer rails having a horizontal portion, said horizontal portion having a rail stop;

a detachable roller, which is detachably mounted in a rear end of said drawer when said drawer structure is used with a single rail assembly, said detachable roller is removed when said drawer structure is used with a multi-rail assembly;

wherein when said drawer structure is used with a single rail assembly, said compatibility means further comprises:

a pair of first fixed rails for receiving said horizontal portions of said pair of drawer rails, respectively, each of said first fixed rails having a first roller fixed at a front end thereof which, in cooperation with said detachable roller, allows said drawer body to move slidably, said first fixed rail further having a first stop lug, which, in cooperation with said rail stop, prevents said drawer body from being pulled completely out;

and when said drawer structure is used with a multi-rail assembly, said compatibility means further comprises:

a pair of second fixed rails and a pair of extension rails, said second fixed rails and said extension rails are structured such that said extension rails, which will receive said drawer rails, are received by said second fixed rails, respectively, and slidably movable therewithin;

each of said extension rails comprises a pair of generally vertically aligned pressing rollers for slidably receiving said horizontal portion of said drawer rail therebetween;

said extension rail further comprises a friction means provided by said pair of pressing rollers to cause said drawer body and said extension rails to move together within said second fixed rails up to a predetermined distance when said drawer body is being pulled out; extension roller means for allowing said extension rails to slidably move within said second fixed rails, and a second lug, which, in cooperation with a third lug provided on said second fixed rail, stops a movement of said extension rail and allows said drawer body to move relative to said extension rail.

2. A drawer assembly comprising:

a pair of drawer rails affixed to a right and left side, respectively, of a drawer body, each of said drawer rails having a horizontal portion, said horizontal portion having a rail stop;

a detachable roller, which is detachably mounted in a rear end of said drawer when said drawer structure is used with a single rail assembly, said detachable roller is removed when said drawer structure is used with a multi-rail assembly;

a single rail assembly; and a multi-rail assembly;

wherein said single rail assembly comprises:

a pair of first fixed rails for receiving said horizontal portions of said pair of drawer rails, respectively, each of said first fixed rails having a first roller fixed at a front end thereof which, in cooperation with said detachable roller, allows said drawer body to move slidably, said first fixed rail further having a first stop lug, which, in cooperation with said rail stop, prevents said drawer body from being pulled completely out;

and said multi-rail assembly comprises:

a pair of second fixed rails and a pair of extension rails, said second fixed rails and said extension rails are structured such that said extension rails, which will receive said drawer rails, are received by said second fixed rails, respectively, and slidably movable therewithin;

each of said extension rails comprises a pair of generally vertically aligned pressing rollers for slidably receiving said horizontal portion of said drawer rail therebetween;

said extension rail further comprises a friction means provided by said pair of pressing rollers to cause said drawer body and said extension rails to move together within said second fixed rails up to a predetermined distance when said drawer body is being pulled out; extension roller means for allowing said extension rails to slidably move within said second fixed rails, and a second lug, which, in cooperation with a third lug provided on said second fixed rail, stops a movement of said extension rail and allows said drawer body to move relative to said extension rail.

* * * * *